US006546227B2

(12) United States Patent
Miyakoshi et al.

(10) Patent No.: US 6,546,227 B2
(45) Date of Patent: Apr. 8, 2003

(54) CONTINUOUS-MEDIUM-BOX FEEDING DEVICE HAVING A STAND-BY TABLE CAPABLE OF FEEDING A CONTINUOUS-MEDIUM BOX ON A SET TABLE

(75) Inventors: Kunio Miyakoshi, Kawasaki (JP); Masatoshi Kobayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/000,135

(22) Filed: Dec. 4, 2001

(65) Prior Publication Data

US 2003/0035670 A1 Feb. 20, 2003

(30) Foreign Application Priority Data

Aug. 17, 2001 (JP) ..... 2001-248219

(51) Int. Cl.[7] ..... G03G 15/00; B65H 3/44

(52) U.S. Cl. ..... 399/384; 271/9.1; 399/391

(58) Field of Search ..... 399/381, 384, 399/388, 391, 393; 271/3.1, 9.01, 9.08, 9.1, 145; 226/83; 400/611, 613, 613.2

(56) References Cited

U.S. PATENT DOCUMENTS 3,831,829 A * 8/1974 Karpisek ..... 226/83
4,515,490 A * 5/1985 Marker, III ..... 400/613.2
4,941,377 A * 7/1990 Ishihara et al. ..... 271/9.1 R X
5,317,365 A * 5/1994 Tschiderer et al. ..... 399/384
5,829,898 A * 11/1998 Hill et al. ..... 271/3.1 R X

FOREIGN PATENT DOCUMENTS

| | | |
|---|---|---|
| JP | 62-48582 | 3/1987 |
| JP | 6-342994 | 12/1994 |
| JP | 10-297775 | 11/1998 |
| JP | 11-298192 | 10/1999 |

* cited by examiner

*Primary Examiner*—Hoan Tran
(74) *Attorney, Agent, or Firm*—Armstrong, Westerman & Hattori, LLP

(57) ABSTRACT

A continuous-medium-box feeding device feeds a continuous-medium box to a printing device printing on a continuous medium fed from the continuous-medium box containing the continuous medium. The continuous-medium-box feeding device includes a set table capable of sliding between a first position and a second position adjacent to the first position, and a stand-by table capable of sliding between the first position and a third position adjacent to the second position. At the first position, the continuous medium can be fed from the continuous-medium box to the printing device. At the second position, the continuous-medium box can be removed from the set table. At the second and third positions, a continuous-medium box containing a continuous medium to be printed on next can be placed on the stand-by table. In the continuous-medium-box feeding device, the stand-by table can feed the continuous-medium box on the set table positioned at the first position.

9 Claims, 10 Drawing Sheets

CONTINUOUS-MEDIUM-BOX FEEDING DEVICE HAVING A STAND-BY TABLE CAPABLE OF FEEDING A CONTINUOUS-MEDIUM BOX ON A SET TABLE

BACKGROUND OF THE INVENTION

1. Field of the Invention

The present invention generally relates to a continuous-medium-box feeding device and, more particularly, to a continuous-medium-box feeding device adopted in a printing device printing on a continuous medium in which the continuous-medium-box feeding device feeds a continuous-medium box to a hopper unit feeding the continuous medium to a printing unit.

Some of printing devices, such as an electrophotographic printer, perform a printing on a continuous paper, which is an example of a continuous medium. The continuous paper here means a continuous paper having crosswise perforations. The continuous paper is folded up by being turned alternately at the crosswise perforations, and is contained in a box.

Regarding such printing devices as an electrophotographic printer printing on this continuous paper, there is a need for increasing a printing throughput. Increasing the printing throughput necessitates the increase in a printing speed and the shortening of a time during which the printing device halts a printing operation from the completion of a printing on one continuous paper until the start of a printing on the next continuous paper.

Recently, the printing speed is improved to such a high speed that completes printing on two thousand forms in approximately 5 minutes. Thereupon, in order to shorten the time during which the printing device halts the printing operation for feeding the next continuous paper, there is a need for shortening a time required to feed the continuous paper.

2. Description of the Related Art

In a conventional electrophotographic printer printing on a continuous paper, a hopper unit is a simple space. The undersurface of the hopper unit is a part of the surface of a floor on which the electrophotographic printer is installed.

Conventionally, a continuous paper is fed according to the hereinbelow-described procedure, after the printing on the present continuous paper is finished.

(1) An operator draws the emptied box out of the hopper unit, making the hopper unit vacant. (2) The operator retrieves the printed continuous paper from a stacker unit, and puts the printed continuous paper into the empty box. (3) The operator shifts a continuous-paper box containing the next continuous paper past the entrance of the hoper unit into the hopper unit by pushing and sliding the continuous-paper box on the floor. (4) The operator draws the next continuous paper from the continuous-paper box, and sets the next continuous paper to a form-autoloading unit of the electrophotographic printer. The operator of the electrophotographic printer needs to perform this procedure frequently.

The entrance of the hopper unit needs to be kept unoccupied for the purpose of drawing the emptied box out of the hopper unit. Therefore, the continuous-paper box containing the continuous paper to be printed on next is placed at a position away from the entrance of the hopper unit. This lengthens the distance to cover in shifting the heavy continuous-paper box, and therefore, makes the task of shifting and pushing the continuous-paper box into the hopper unit burdensome and time-consuming.

Besides, in order to alleviate the burden posed on the operator of the electrophotographic printer, there is a conventional structure in which the hopper unit is provided with a drawable table. This table is used for supporting the continuous-paper box and shifting the continuous-paper box.

The continuous-paper box is fed into the hopper unit according to the hereinbelow-described procedure, after the printing on the present continuous paper is finished.

(1) An operator draws the emptied box out of the hopper unit by pulling out the table. (2) The operator unloads the emptied box from the table. (3) The operator places a continuous-paper box containing the next continuous paper on the table. (4) The operator pushes the table into the hopper unit. Thereby, the continuous-paper box is fed in the hopper unit.

The task (3) of placing the continuous-paper box containing the next continuous paper on the table needs to be performed after the tasks (1) and (2) of pulling out the table and unloading the emptied box from the table. Therefore, it has been difficult to shorten the time from the completion of a printing on one continuous paper until the start of a printing on the next continuous paper.

SUMMARY OF THE INVENTION

It is a general object of the present invention to provide an improved and useful continuous-medium-box feeding device in which the above-mentioned problems are eliminated.

A more specific object of the present invention is to provide a continuous-medium-box feeding device which can feed the next continuous-medium box into a hopper unit of a printing device in a short time after finishing a printing on the present continuous paper.

In order to achieve the above-mentioned objects, there is provided according to one aspect of the present invention a continuous-medium-box feeding device feeding a continuous-medium box to a printing device printing on a continuous medium fed from the continuous-medium box containing the continuous medium, the continuous-medium-box feeding device comprising:

a set table capable of sliding between a first position and a second position adjacent to the first position, the first position enabling the continuous medium to be fed from the continuous-medium box to the printing device, and the second position enabling the continuous-medium box to be removed manually; and a stand-by table capable of sliding between the first position and a third position adjacent to the second position, the second position and the third position enabling a continuous-medium box containing a continuous medium to be printed on next to be placed manually, wherein the stand-by table can feed the continuous-medium box on the set table positioned at the first position.

According to the present invention, the continuous-medium box containing the continuous medium to be printed on next can be placed on the stand-by table positioned at the second or third position during a printing operation to a prior continuous medium so that the continuous-medium box is ready for the feeding of the continuous medium. In addition, when the printing operation to the prior continuous medium is finished, simply shifting the set table and the stand-by table enables both the removal of the emptied continuous-medium box and the subsequent feeding of the next continuous-medium box to the first position to be performed in a short time. Therefore, providing the continuous-medium printing device with the continuous-medium-box feeding device according to the present invention can shorten a time during which the printing device halts due to the consumption of the continuous medium to the end; this increases a printing throughput.

Additionally, the continuous-medium-box feeding device according to the present invention may further comprise a continuous-medium-box holder holding the continuous-medium box on the set table, the continuous-medium box being shifted from the stand-by table onto the set table by sliding the stand-by table from the third position to the first position.

According to the present invention, upon sliding the stand-by table from the first position to the third position in the course of shifting the continuous-medium box from the stand-by table onto the set table, the continuous-medium box can be held on the first position on the set table where the continuous medium can be fed from the continuous-medium box for printing.

Additionally, the continuous-medium-box feeding device according to the present invention may further comprise a box remover pushing out the continuous-medium box off the set table positioned at the second position.

According to the present invention, an operator does not have to perform the task of removing the continuous-medium box off the set table positioned at the second position; this alleviates the burden posed on the operator of the printing device.

Additionally, the continuous-medium-box feeding device according to the present invention may further comprise:

- a set-table sliding unit sliding the set table between the first position and the second position;
- a stand-by-table sliding unit sliding the stand-by table between the third position and the first position; and
- a control circuit controlling operations of the set-table sliding unit and the stand-by-table sliding unit to firstly shift the set table from the first position to the second position, subsequently shift the set table from the second position to the first position, and finally shift the stand-by table from the third position to the first position so that the continuous-medium box containing the continuous medium to be printed on next is fed onto the set table positioned at the first position in place of the continuous-medium box having fed the continuous medium to the printing device.

According to the present invention, the continuous-medium box can be automatically fed to the printing device in a short time; this further increases the printing throughput, and also alleviates the burden posed on the operator of the printing device.

In order to achieve the above-mentioned objects, there is also provided according to another aspect of the present invention a continuous-medium printing device including the above-mentioned continuous-medium-box feeding device.

According to the present invention, the feeding of the continuous-medium box can be performed in a short time; therefore, the continuous-medium printing device can increase a printing throughput thereof.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments according to the present invention.

EMBODIMENT 1

Figure 1:
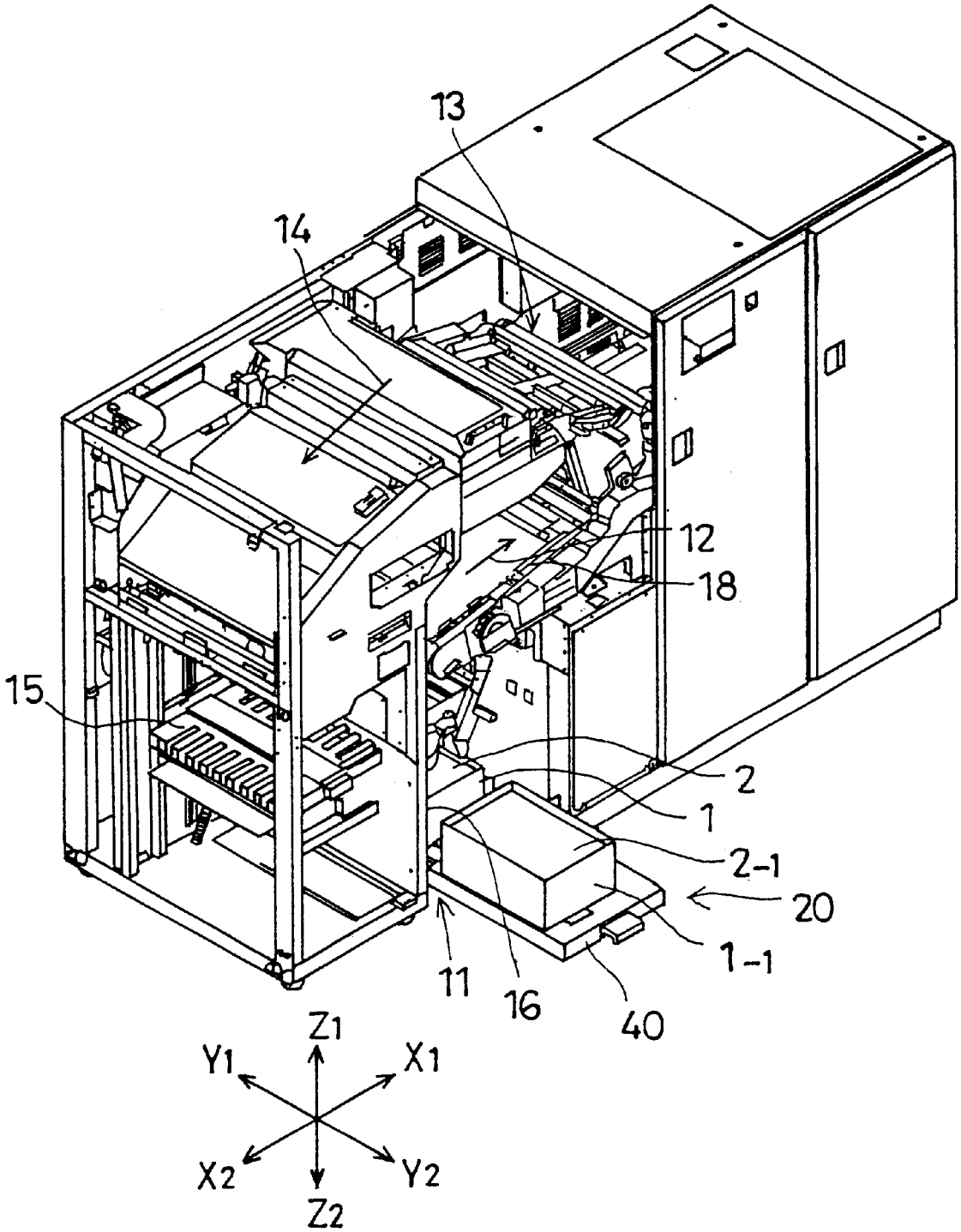
FIG. 1 is an illustration showing an electrophotographic printer adopting a continuous-medium-box feeding device according to a first embodiment of the present invention.

FIG. 1 shows an electrophotographic printer 10 (a continuous-medium printing device) adopting a continuous-medium-box feeding device according to a first embodiment of the present invention. X1-X2 indicates the direction of width. Y1-Y2 indicates the direction of depth. Z1-Z2 indicates the direction of height. Y2 indicates the front side of the electrophotographic printer 10. Y1 indicates the backside of the electrophotographic printer 10.

The electrophotographic printer 10 comprises a hopper unit 11, a printing unit 13, and a stacker unit 15. A continuous-medium box 1 is set in the hopper unit 11. The continuous-medium box 1 contains a continuous medium 2 folded up zigzag by being turned alternately at crosswise perforations. The continuous medium 2 is drawn out from the continuous-medium box 1 set in the hopper unit 11, and is sent toward a direction indicated by an arrow 12. The printing unit 13 prints on the continuous medium 2. The printed continuous medium 2 is sent toward a direction indicated by an arrow 14, and is folded up zigzag by being turned in alternate directions at the crosswise perforations so as to be contained in the stacker unit 15.

The hopper unit 11 has an opening 16 at the front side of the electrophotographic printer 10.

As shown in FIG. 2 to FIG. 5, a continuous-medium-box feeding device 20 is provided in the hopper unit 11 of the electrophotographic printer 10. P1 indicates a position of the hopper unit 11. P2 indicates a position out of the hopper unit 11 at the front side of the electrophotographic printer 10. P3 indicates a position farther from the position P2 at the front side of the electrophotographic printer 10.

The continuous-medium-box feeding device 20 includes a set table 30 and a stand-by table 40. Both the set table 30 and the stand-by table 40 can slide out and in. Each of the set table 30 and the stand-by table 40 has a size corresponding to the continuous-medium box 1. The stand-by table 40 slides in on the upper surface of the set table 30.

A beam member 50 is fixed at the bottom portion of the hopper unit 11 of the electrophotographic printer 10 at the X1 side. A guide rail 51 is fixed to the beam member 50. A guide rail 52 is fixed to a wall portion of the hopper unit 11 at the X2 side. The fixed guide rails 51 and 52 oppose each other in the X1-X2 direction. Grooves 51*a* and 52*a* are formed at opposing positions of the fixed guide rails 51 and 52, respectively.

In the set table 30, a slider 32 and a guide rail 33 are fixed to a bracket portion 31 formed at the X1 side. A slider 35 and a guide rail 36 are fixed to a bracket portion 34 formed at the X2 side. The bracket portion 31 has a substantially U-shaped cross section. The bracket portion 34 has a substantially U-shaped cross section. The sliders 32 and 35 are inserted in the grooves 51*a* and 52*a* of the fixed guide rails 51 and 52 in a manner that the sliders 32 and 35 can shift smoothly in the grooves 51*a* and 52*a*, respectively. Thereby, the set table 30 can move in the Y2 direction with respect to the hopper unit 11.

The stand-by table 40 has a slider 42 on an inner side surface of a bracket portion 41 formed at the X1 side, and has a slider 44 on an inner side surface of a bracket portion 43 formed at the X2 side. The sliders 42 and 44 are inserted in grooves 33*a* and 36*a* of the guide rails 33 and 36 in a manner that the sliders 42 and 44 can shift smoothly in the grooves 33*a* and 36*a*, respectively. Thereby, the stand-by table 40 can move in the Y2 direction with respect to the set table 30.

Figure 2:
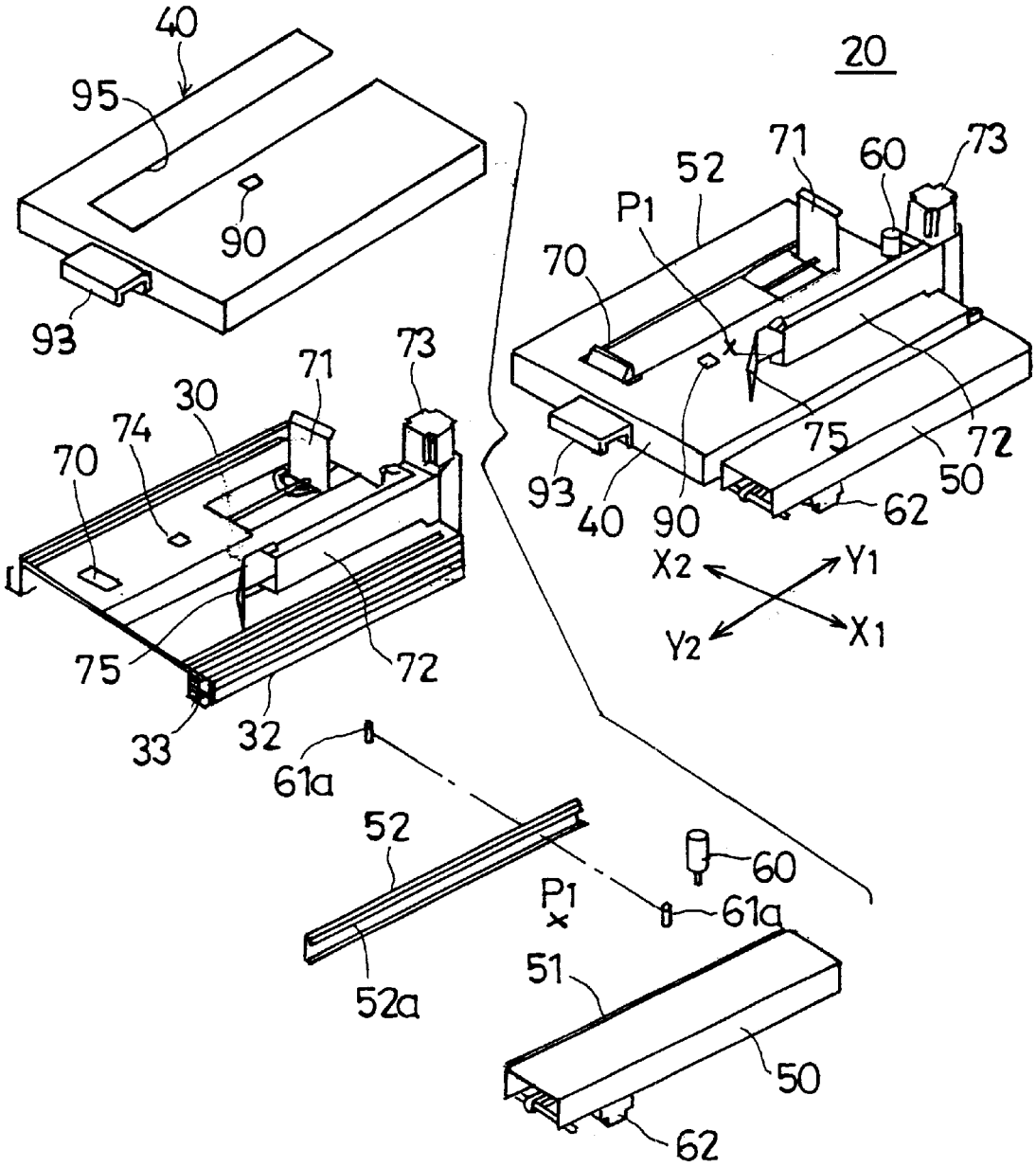
FIG. 2 is a perspective view showing a first state of the continuous-medium-box feeding device according to the first embodiment of the present invention.
Figure 3:
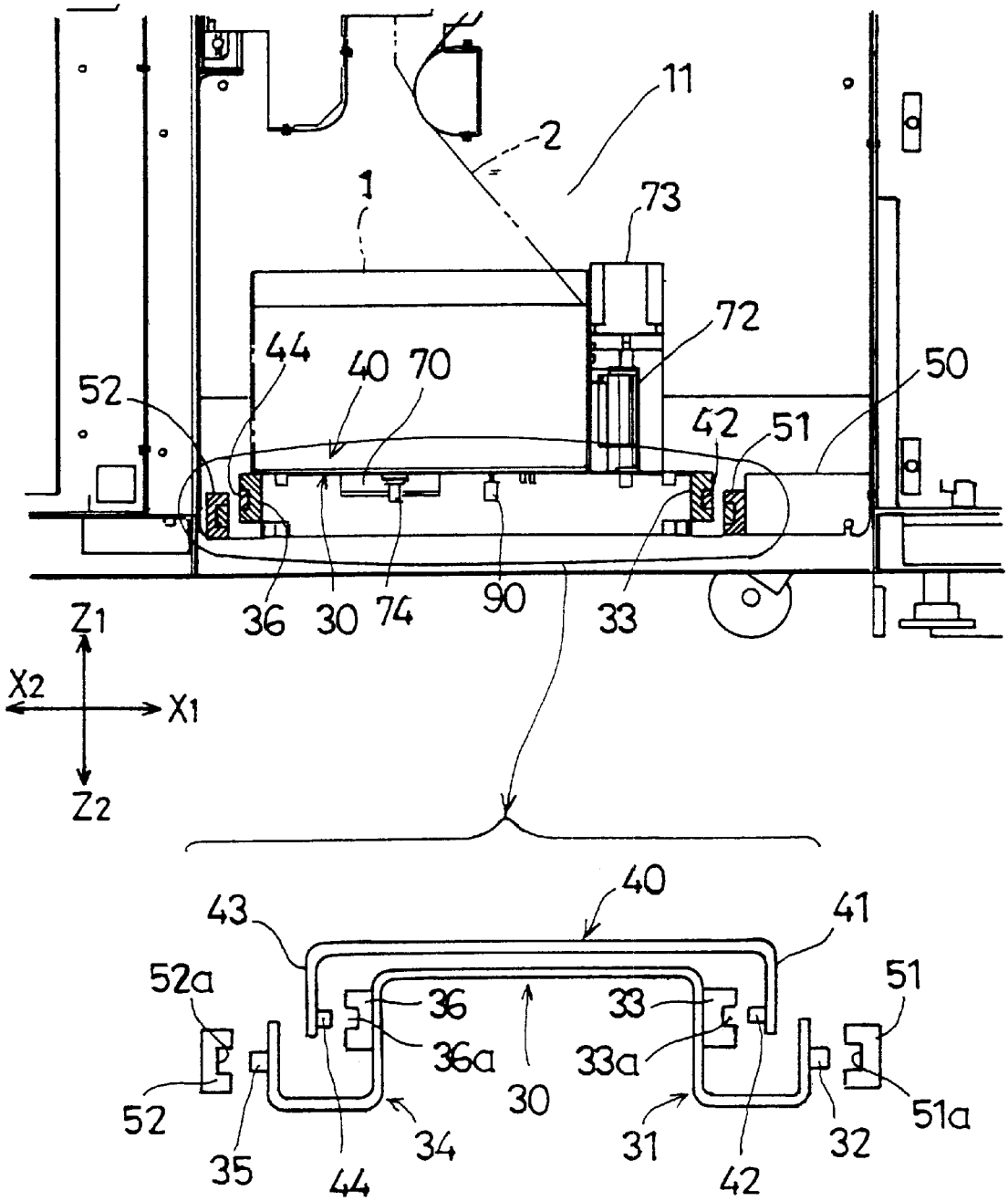
FIG. 3 is a cross-sectional view, as seen from the front side, of the continuous-medium-box feeding device shown in FIG. 2.
Figure 4:
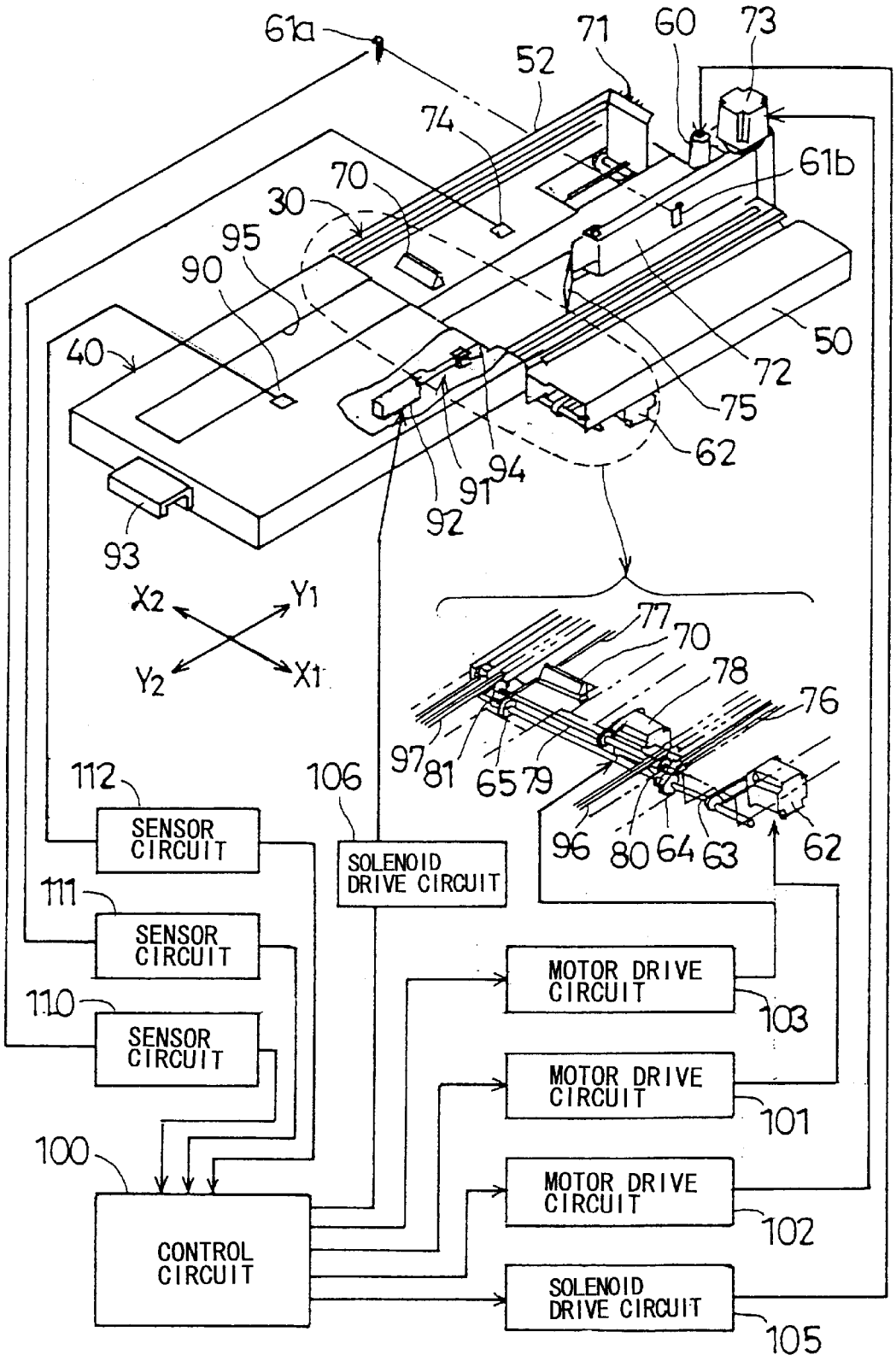
FIG. 4 is an illustration showing a second state of the continuous-medium-box feeding device shown in FIG. 2, along with a control system.
Figure 5:
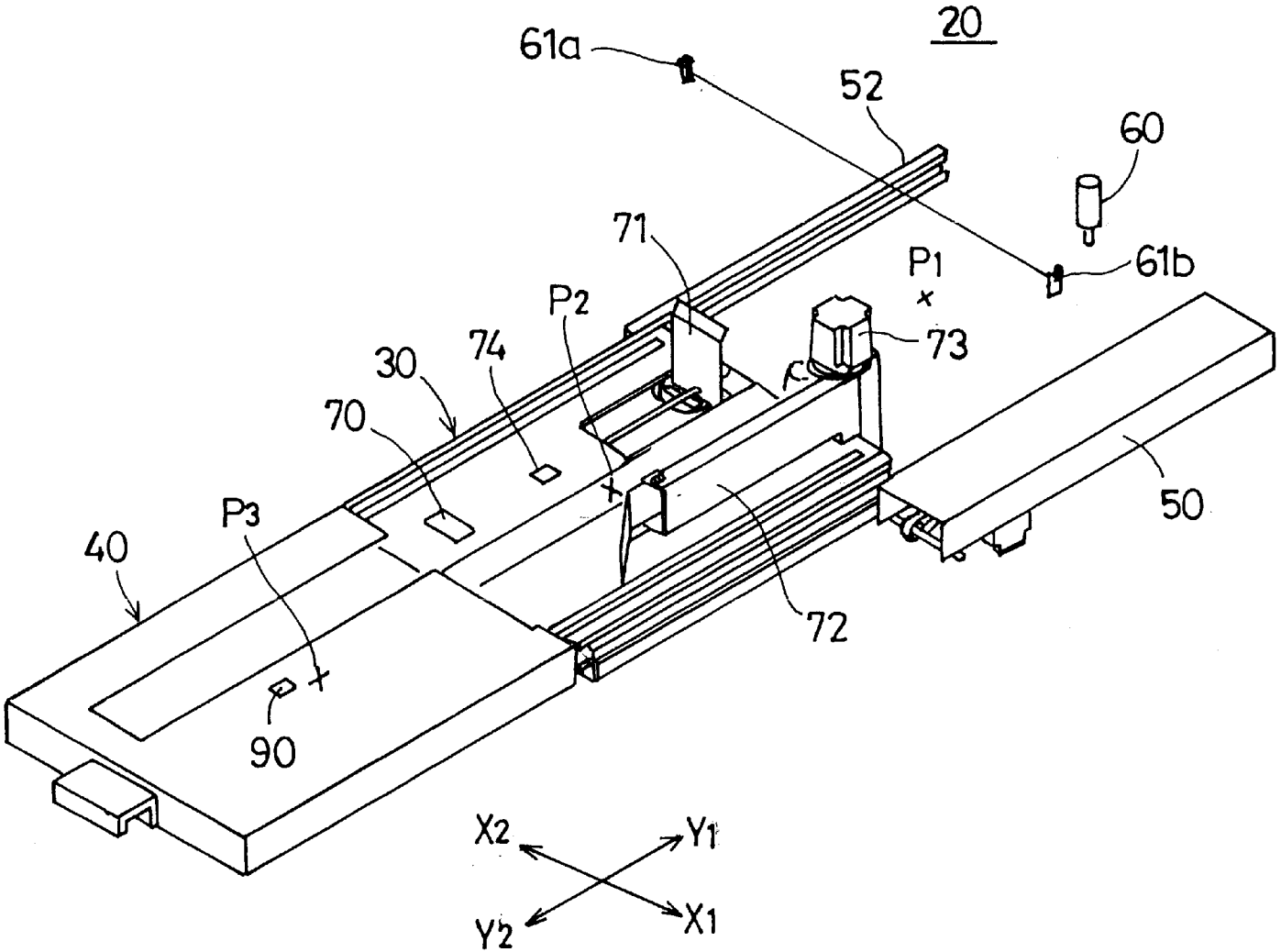
FIG. 5 is a perspective view showing a third state of the continuous-medium-box feeding device shown in FIG. 2.

The set table 30 and the stand-by table 40 can slide out and in with respect to the fixed guide rails 51 and 52 such that the continuous-medium-box feeding device 20 assumes a first state shown at the right side of FIG. 2, a second state shown at the upper side of FIG. 4, and a third state shown in FIG. 5. In the first state, both the set table 30 and the stand-by table 40 are at the position P1. In the second state, the set table 30 is at the position P1, and the stand-by table 40 is at the position P2. In the third state, the set table 30 is at the position P2, and the stand-by table 40 is at the position P3.

P1 is a first position of the set table 30. In this position P1, the continuous medium 2 can be fed from the continuous-medium box 1 to the electrophotographic printer 10. P2 is a second position of the set table 30. In this position P2 next to the position P1, the continuous-medium box 1 can be removed manually. P3 is a third position of the stand-by table 40. In this position P3 next to the position P2, the continuous-medium box 1 containing the continuous medium 2 to be printed on next can be placed manually.

The hopper unit 11 of the electrophotographic printer 10 is provided with a solenoid 60 locking the set table 30 to inhibit the shifting thereof, and EOF (End Of Forms) sensors 61*a* and 61*b* detecting optically that the continuous medium 2 is drawn out and used up to the end. The solenoid 60, and the EOF sensors 61*a* and 61*b* form a set-table locking unit.

A pulse motor 62 for shifting the set table is provided in the beam member 50. A rotary axle 63 is provided across the hopper unit 11 in the X1-X2 direction. The rotary axle 63 is belt-driven by the motor 62. Pinions 64 and 65 fixed to the rotary axle 63 mesh racks 76 and 77 on the undersurface of the set table 30.

The pulse motor 62, the rotary axle 63, the pinions 64 and 65, and the racks 76 and 77 form a set-table sliding unit.

The set table 30 includes, on the upper surface thereof, a pair of continuous-medium-box holders 70 and 71, an empty-box removing arm (a box remover) 72, a pulse motor 73 causing this empty-box removing arm 72 to revolve clockwise, and a microswitch 74 sensing the continuous-medium box 1. The continuous-medium-box holder 71 forms a positioning mechanism.

The continuous-medium-box holder 70 at the Y2 side has a shape of a trigonal prism. The continuous-medium-box holder 70 can collapse in the Y1 direction, but does not collapse in the Y2 direction. The continuous-medium-box holder 71 at the Y1 side can be shifted in the Y1-Y2 direction, and can be fixed at one of a plurality of predetermined positions. Therefore, the continuous-medium-box holder 71 can be fixed at a position corresponding to a size of the continuous-medium box. The continuous-medium-box holder 70 forms a continuous-medium-box shift stopping means.

The empty-box removing arm 72 is positioned along the X1 side of the set table 30, and has a guide arm 75 on an end thereof.

A pulse motor 78 for shifting the stand-by table and a rotary axle 79 belt-driven by the motor 78 are provided on the undersurface of the set table 30. Pinions 80 and 81 fixed to the rotary axle 79 mesh racks 96 and 97 on the undersurface of the stand-by table 40.

The pulse motor 62, the rotary axle 63, the pinions 64 and 65, the racks 76 and 77, the pulse motor 78, the rotary axle 79, the pinions 80 and 81, and the racks 96 and 97 form a stand-by-table sliding unit.

The stand-by table 40 includes a microswitch 90 detecting the presence of the continuous-medium box, a coupling mechanism 91 coupling the stand-by table 40 and the set table 30, a decoupling solenoid 92, and a handle 93. The coupling mechanism 91 includes a hook 94. The coupling mechanism 91, the decoupling solenoid 92, and the hook 94 form a stand-by-table locking unit.

An incision 95 evading the continuous-medium-box holder 70 is formed in the stand-by table Additionally, as shown in FIG. 4, the continuous-medium-box feeding device 20 is provided with a control circuit 100, motor drive circuits 101, 102 and 103, solenoid drive circuits 105 and 106, and sensor circuits 110, 111 and 112.

Next, a description will be given of operations of the continuous-medium-box feeding device 20 having the above-described structure.

When the continuous medium 2 is drawn out from the continuous-medium box 1 such that a printing is being performed on the continuous medium 2, the continuous-medium-box feeding device 20 is in the second state shown in FIG. 4.

Figure 6A:
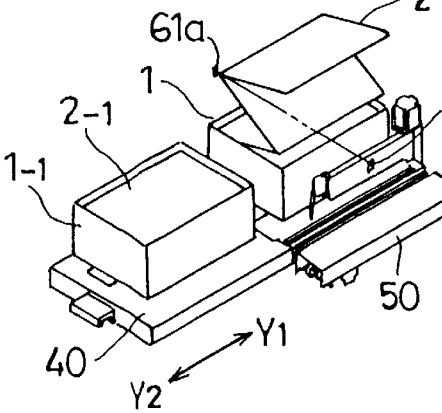
FIG. 6A to FIG. 6F are illustrations showing states of the continuous-medium-box feeding device shown in FIG. 2 in operation.

During this printing operation, an operator places the continuous-medium box 1-1 containing the continuous medium 2-1 to be printed on next on the stand-by table 40. It is sufficient for the continuous-medium box 1-1 to be placed at a substantially central position on the stand-by table 40. The microswitch 90 is pressed "on" by the continuous-medium box 1-1. FIG. 6A shows this state.

Figure 6B:
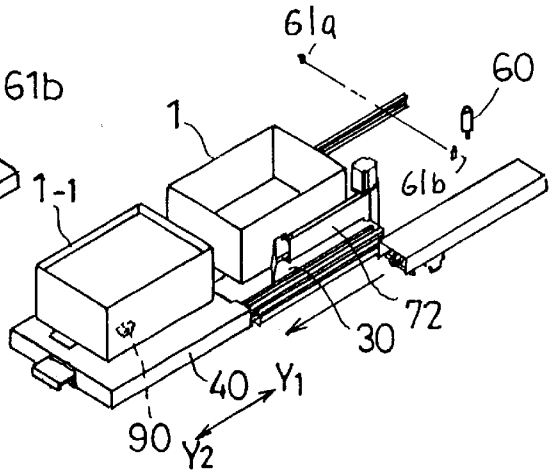

When the continuous medium 2 is drawn out to the end, the EOF sensors 61*a* and 61*b* detect the same. According to this detection by the EOF sensors 61*a* and 61*b*, the solenoid 60 is turned off so as to unlock the set table 30. Subsequently, the motor 62 is driven so as to shift the set table 30 in the Y2 direction. At this point, the continuous-medium-box feeding device 20 is in the third state shown in FIG. 5. The empty continuous-medium box 1 is drawn out of the hopper unit 11. At this point, the continuous-medium-box feeding device 20 is in a state shown in FIG. 6B.

Figure 6C:
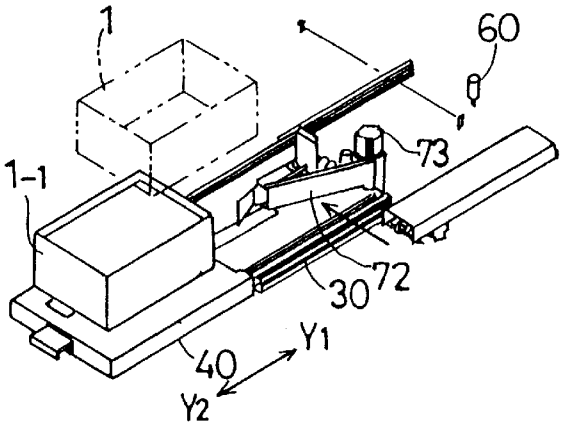

Then, the motor 73 is driven so as to cause the empty-box removing arm 72 to revolve clockwise, as shown in FIG. 6C, so as to push out the empty continuous-medium box 1 in the X2 direction off the set table 30. The microswitch 74 is turned off. At this point, the position of the continuous-medium-box holder 71 is adjusted, if necessary.

Figure 6D:
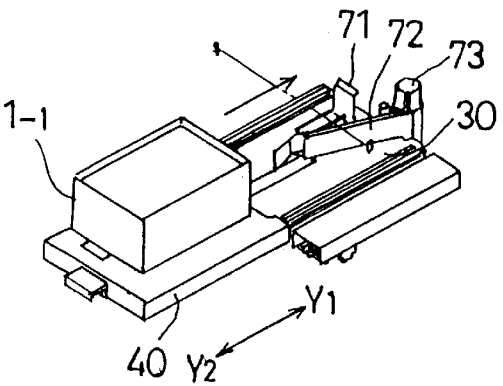

Subsequently, the motor 62 is driven so as to shift the set table 30 in the Y1 direction. At this point, the continuous-medium-box feeding device 20 is back in the second state. The hopper unit 11 is vacant. The continuous-medium box 1-1, while on the stand-by table 40, is shifted to the position P2. At this point, the continuous-medium-box feeding device 20 is in a state shown in FIG. 6D.

Then, the solenoid 92 is turned on so as to revolve the hook 94 to an unhooking state; thereby, the coupling mechanism 91 decouples the stand-by table 40 and the set table 30. Subsequently, the pulse motor 78 is driven so as to shift the stand-by table 40 in the Y1 direction. At this point, the continuous-medium-box feeding device 20 is in the first state shown in FIG. 2. The continuous-medium box 1-1, while on the stand-by table 40, is shifted in the Y1 direction. In the course of the shifting, the continuous-medium box 1-1 brings down the continuous-medium-box holder 70, and pushes the guide arm 75 so as to cause the empty-box removing arm 72 to revolve counterclockwise. The continuous-medium box 1-1 is shifted to an end position that meets the continuous-medium-box holder 71, determining the position in the Y1-Y2 direction. The continuous-medium-box holder 70 rises up such that the continuous-medium box 1-1 is flanked by the continuous-medium-box holders 71 and 70. The microswitch 74 is turned on.

The width of the continuous-medium box 1-1 in the X1-X2 direction relates to the folding size of the continuous medium 2-1. Depending on the size of the continuous-medium box 1-1, the revolving position of the empty-box removing arm 72 varies. A sensor (not shown in the figures) detecting the revolving position of the empty-box removing arm 72 is provided. This sensor detects the revolving position of the empty-box removing arm 72 so as to detect the folding size of the continuous medium 2-1.

Figure 6E:
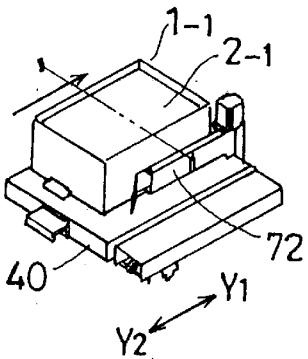

The continuous-medium-box feeding device 20 is in a state shown in FIG. 6E in which the continuous-medium box 1-1 is fed in the hopper unit 11 at a predetermined position.

Figure 6F:
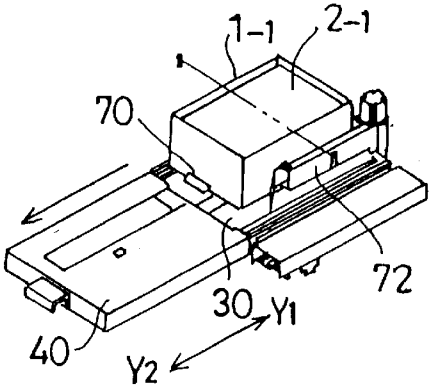

Finally, the pulse motor 78 is driven so as to shift the stand-by table 40 in the Y2 direction. At this point, the continuous-medium-box feeding device 20 is in the second state. The shifting range of the continuous-medium box 1-1 in the Y2 direction is restricted by the continuous-medium-box holder 70. Therefore, the stand-by table 40 is shifted in the Y2 direction so as to jut out of the hopper unit 11, leaving the continuous-medium box 1-1 at the position P1. The continuous-medium box containing the continuous medium to be printed on next after the next is placed on the stand-by table 40. The continuous-medium-box feeding device 20 is in a state shown in FIG. 6F.

The operator draws out the continuous medium 2-1 from the continuous-medium box 1-1, sets the continuous medium 2-1 to a form-autoloading unit 18 of the electrophotographic printer 10, and presses a print start button (not shown in the figures). The electrophotographic printer 10 starts printing on the continuous medium 2-1.

As can be understood from the above description, the time required to feed the continuous-medium box 1-1 into the hopper unit 11 is shortened mainly due to the following reasons.

(1) A laborious task to put the heavy continuous-medium box 1-1 on the stand-by table 40 is performed while the electrophotographic printer 10 performs the printing operation. Therefore, the task can be performed without causing any problem, even when the task takes a long time.

(2) The shifting of the continuous-medium box 1-1 is performed by the shifting stand-by table 40.

(3) The shifting of the stand-by table 40 is performed by the pulse motor 78.

(4) The continuous-medium-box holder 71 stopping the continuous-medium box 1-1 determines the position of the continuous-medium box 1-1 in the hopper unit 11.

Besides, as the printing proceeds, the continuous-medium box 1-1 becomes lighter in weight such that vibrations during the printing operation of the electrophotographic printer 10 may displace the continuous-medium box 1-1. When the continuous-medium box 1-1 is displaced, the position at which the continuous medium 2-1 is fed to the electrophotographic printer 10 is displaced from a normal position such that a form jam may occur. However, in the continuous-medium-box feeding device 20, the continuous-medium-box holders 71 and 70 flank the continuous-medium box 1-1; thereby, the continuous-medium box 1-1 will not be displaced even when affected by such vibrations. Therefore, the continuous-medium box 1-1 is held at a normal position throughout the printing performed for the continuous medium 2-1 contained therein so as to prevent the occurrence of a form jam due to the displacement of the continuous-medium box 1-1.

Figure 7:
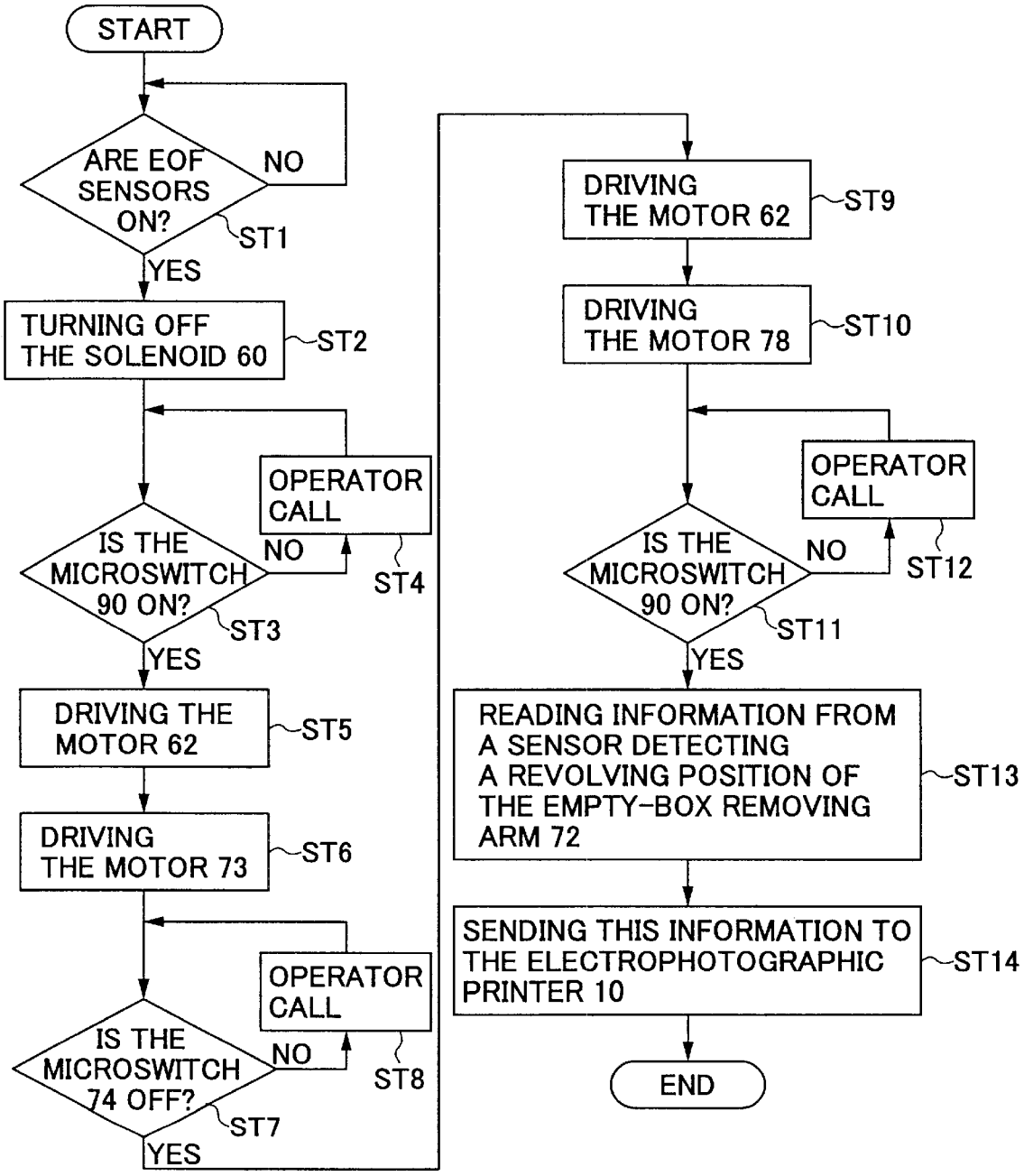
FIG. 7 is a flowchart of operations of a control circuit shown in FIG. 4, upon feeding a continuous-medium box.

Besides, the above-described continuous-medium-box feeding device 20 performs the printing operation under control of the control circuit 100. A microcomputer forming the control circuit 100 performs operations shown in FIG. 7.

When the EOF sensors 61*a* and 61*b* turn on, the microcomputer turns the solenoid 60 off (ST1, ST2).

When the microswitch 90 is off, the microcomputer performs an operator call to prompt attention (ST3, ST4). After confirming that the microswitch 90 is on, the microcomputer drives the motor 62 (ST3, ST5). Subsequently, the microcomputer drives the motor 73 (ST6).

When the microswitch 74 is on, the microcomputer performs an operator call (ST7, ST8). After confirming that the microswitch 74 is off, the microcomputer drives the motor 62 (ST7, ST9). Subsequently, the microcomputer drives the motor 78 (ST10).

When the microswitch 90 is off, the microcomputer performs an operator call (ST11, ST12). After confirming that the microswitch 90 is on, the microcomputer reads information from the above-mentioned sensor detecting the revolving position of the empty-box removing arm 72, and sends this information to the electrophotographic printer 10 (ST13, ST14).

EMBODIMENT 2

Figure 8:
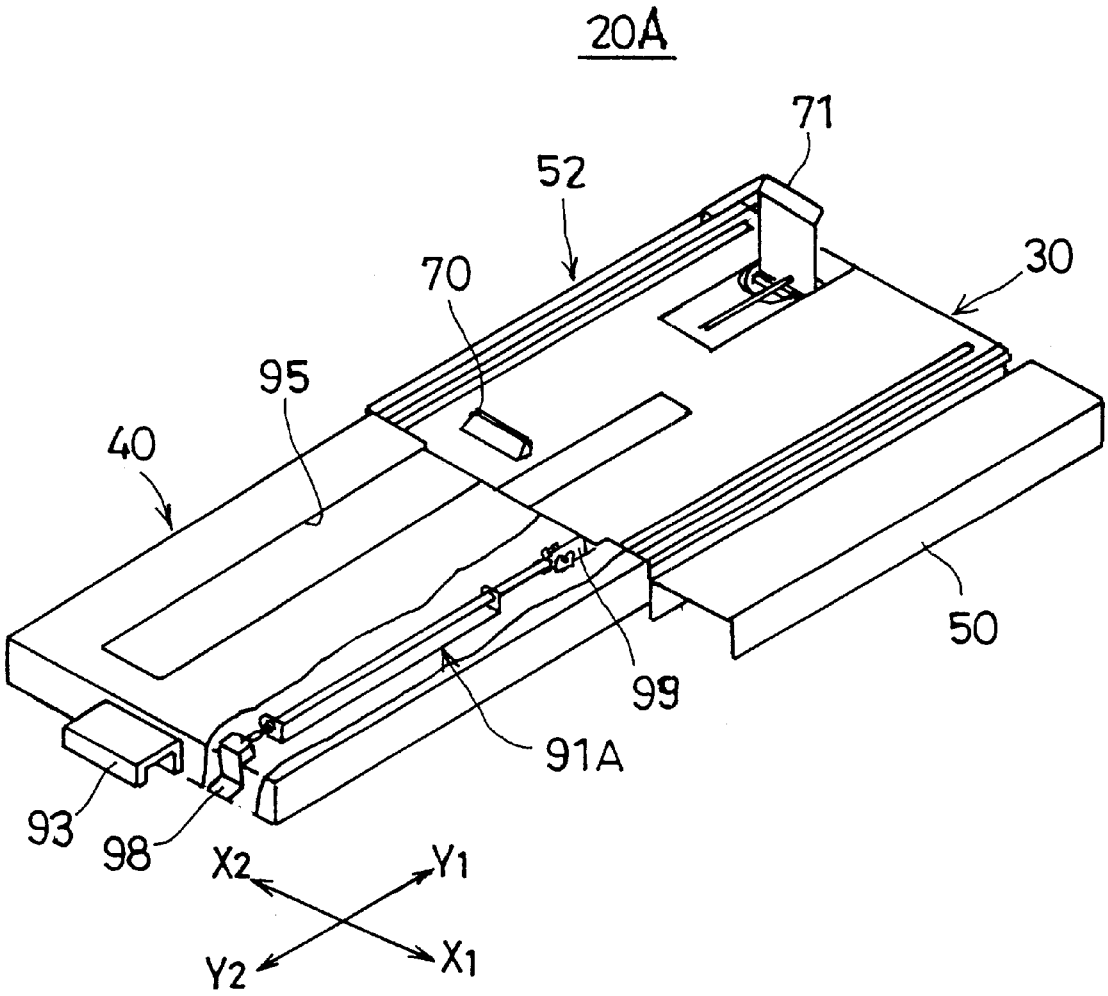
FIG. 8 is a perspective view showing a continuous-medium-box feeding device according to a second embodiment of the present invention.

FIG. 8 shows a continuous-medium-box feeding device 20A according to a second embodiment of the present invention. The continuous-medium-box feeding device 20A is a manually operated type, and comprises the set table 30 and the stand-by table 40.

Unlike the continuous-medium-box feeding device 20 according to the first embodiment, the continuous-medium-box feeding device 20A according to the present second embodiment does not include the motors, the microswitches, or the solenoids. The continuous-medium-box feeding device 20A is not provided with the empty-box removing arm 72 either.

The stand-by table 40 includes a coupling mechanism 91A. The mechanism 91A includes a hook 99 at the Y1 side, and an operation lever 98 at the Y2 side. The hook 99 can be moved by operating the operation lever 98 so as to decouple the stand-by table 40 and the set table 30.

With the continuous-medium-box feeding device 20A, an operator grasps the handle 93 to pull or push the set table 30 and the stand-by table 40 in a manner that the set table 30 and the stand-by table 40 extend or contract like a telescope. Thereby, the continuous-medium box 1-1 placed on the stand-by table is fed into the hopper unit 11.

During the printing state shown in FIG. 6A, the mechanism 91A couples the stand-by table 40 and the set table 30. Therefore, if the stand-by table 40 is pushed in the Y1 direction, the stand-by table 40 does not move, causing no inconvenience.

EMBODIMENT 3

Figure 9:
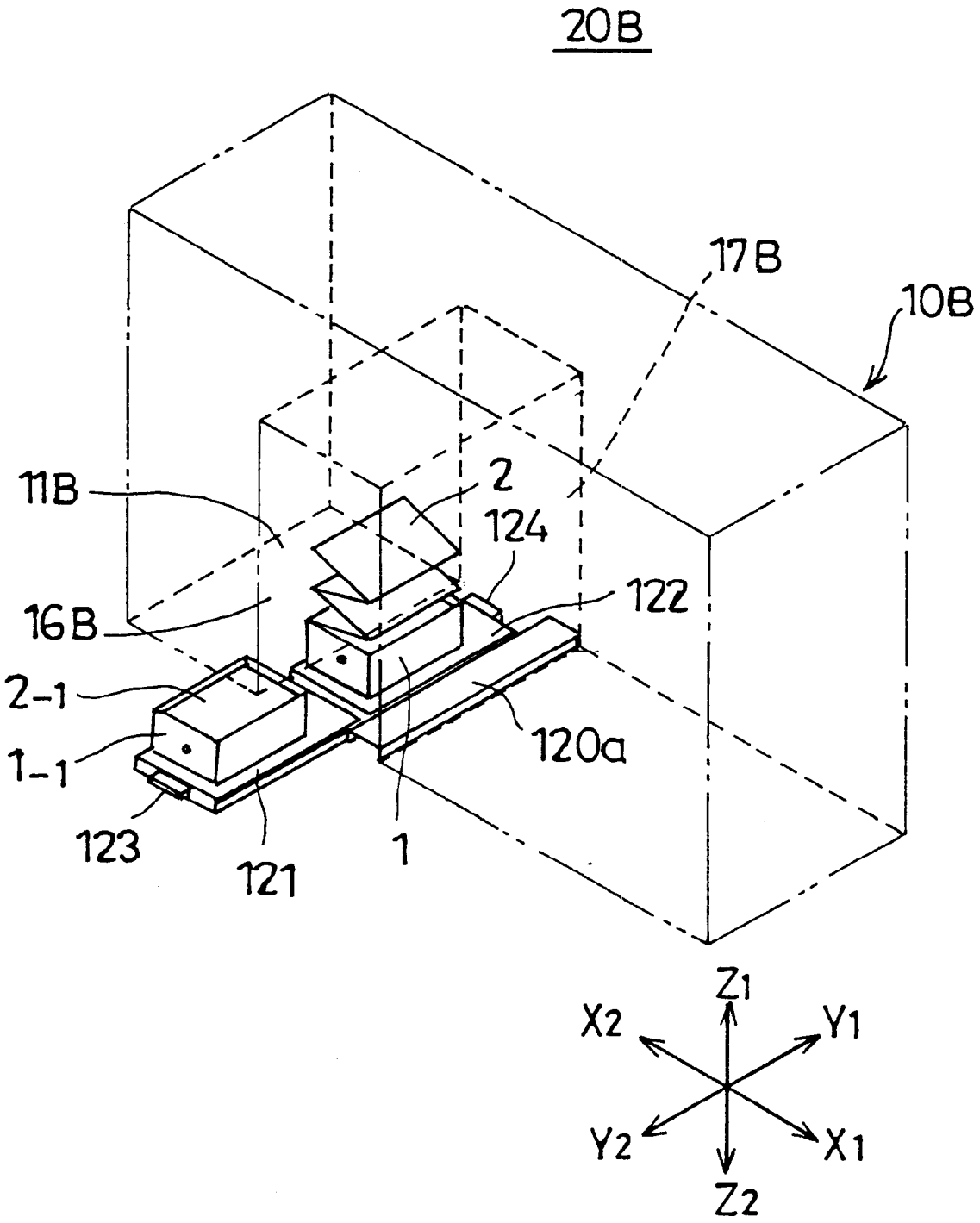
FIG. 9 is a perspective view showing a continuous-medium-box feeding device according to a third embodiment of the present invention.

FIG. 9 shows a continuous-medium-box feeding device 20B according to a third embodiment of the present invention. An electrophotographic printer 10B adopting this continuous-medium-box feeding device 20B includes a hopper unit 11B in the form of a tunnel. The hopper unit 11B has openings 16B and 17B at the front side and the backside of the electrophotographic printer 10B.

The continuous-medium-box feeding device 20B includes a pair of fixed guide rails 120*a* and 120*b* fixed at both sides of the hopper unit 11B in the X1-X2 direction, and a first table 121 and a second table 122 joined together. The fixed guide rails 120*a* and 120*b* extend in the Y1-Y2 direction. The first and second tables 121 and 122 are supported by the fixed guide rails 120*a* and 120*b* in a manner that the first and second tables 121 and 122 can shift smoothly along the fixed guide rails 120*a* and 120*b* in the Y1-Y2 direction. Thereby, when an operator pulls or pushes the first and second tables 121 and 122 by grasping handles 123 and 124, the first and second tables 121 and 122 unitarily shift in the Y1-Y2 direction. Each of the first and second tables 121 and 122 has a size corresponding to the continuous-medium box.

Figure 10A:
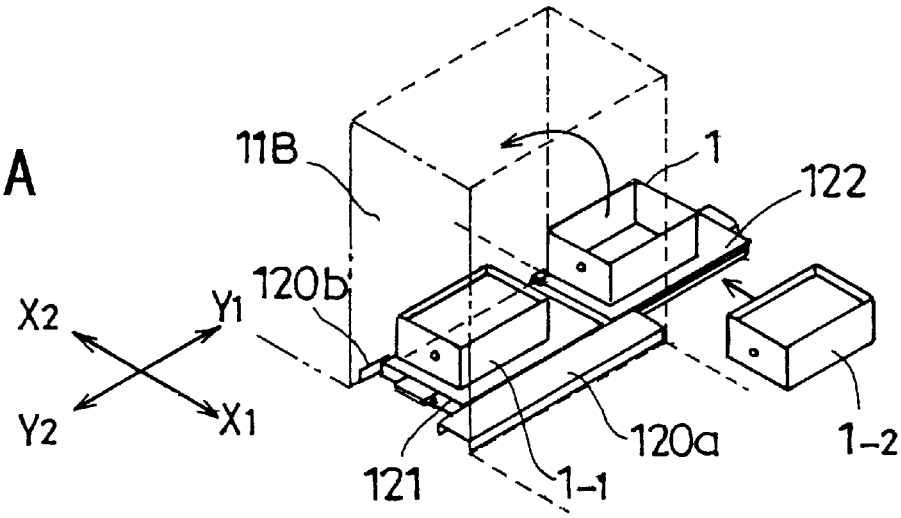
FIG. 10A to FIG. 10C are illustrations showing operations of the continuous-medium-box feeding device shown in FIG. 9.

The continuous-medium-box feeding device 20B assumes either of a first state shown in FIG. 9 and a second state shown in FIG. 10A. In the first state, the second table 122 is positioned in the hopper unit 11B, and the first table 121 juts out from the front side of the electrophotographic printer 10B, as shown in FIG. 9. In the second state, the first table 121 is positioned in the hopper unit 11B, and the second table 122 juts out from the backside of the electrophotographic printer 10B, as shown in FIG. 10A.

Next, a description will be given of operations of the continuous-medium-box feeding device 20B having the above-described structure.

FIG. 9 shows a state where the continuous medium 2 is drawn out from the continuous-medium box 1, and a printing is being performed on the continuous medium 2. The continuous-medium box 1 is placed on the second table 122 positioned in the hopper unit 11B. The first table 121 juts out from the front side of the electrophotographic printer 10B. The second table 122 is at a continuous-medium feeding position. The first table 121 is at a continuous-medium-box loading/unloading position.

During this printing operation, an operator places the continuous-medium box 1-1 containing the continuous medium 2-1 to be printed on next on the first table 121.

When the continuous medium 2 is drawn out to the end, and the printing on the continuous medium 2 is finished, the operator pushes the first table 121 so as to shift the first and second tables 121 and 122 in the Y1 direction.

Thereby, as shown in FIG. 10A, the second table 122 comes out of the hopper unit 11B, juts out from the backside of the electrophotographic printer 10B, and reaches the other continuous-medium-box loading/unloading position. Simultaneously, the first table 121 comes in the hopper unit 11B, and reaches the continuous-medium feeding position. Accordingly, the empty continuous-medium box 1 comes out from the backside of the electrophotographic printer 10B, and the continuous-medium box 1-1 is fed in the hopper unit 11B.

The operator moves to the backside of the electrophotographic printer 10B, where the operator unloads the empty continuous-medium box 1 from the second table 122, and puts the continuous medium 2 contained in the stacker unit 15 into this empty continuous-medium box 1.

Figure 10B:
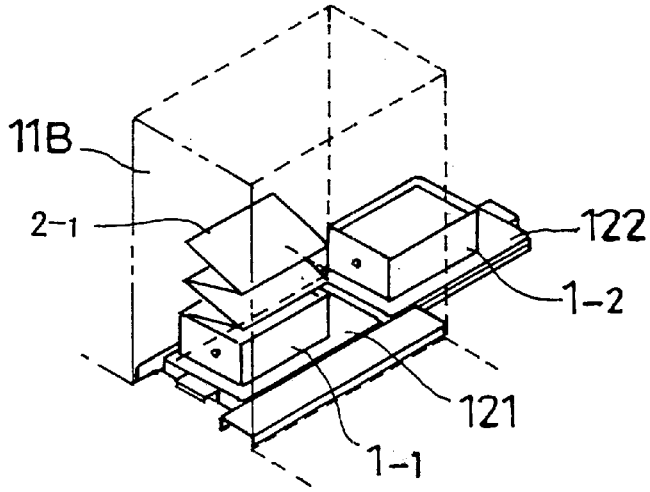

The operator moves to the front side of the electrophotographic printer 10B, where the operator draws out the continuous medium 2-1 from the continuous-medium box 1-1, as shown in FIG. 10B, sets the continuous medium 2-1 to a form-autoloading unit (not shown in the figures) of the electrophotographic printer 10B, and presses a print start button (not shown in the figures). The electrophotographic printer 10B starts printing on the continuous medium 2-1.

During this printing operation, the operator moves to the backside of the electrophotographic printer 10B, where the operator places the continuous-medium box 1-2 containing the continuous medium to be printed on next after the next on the second table 122.

When the continuous medium 2-1 is drawn out to the end, and the printing on the continuous medium 2-1 is finished, the operator pulls the first table 121 so as to shift the first and second tables 121 and 122 in the Y2 direction.

Figure 10C:
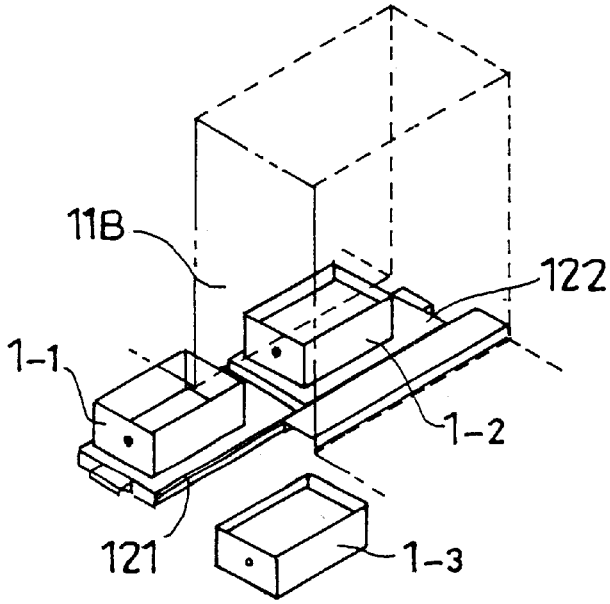

Thereby, as shown in FIG. 10C, the first table 121 comes out of the hopper unit 11B, and juts out from the front side of the electrophotographic printer 10B. Simultaneously, the second table 122 comes in the hopper unit 11B. Accordingly, the empty continuous-medium box 1-1 comes out from the front side of the electrophotographic printer 10B, and the continuous-medium box 1-2 is fed in the hopper unit 11B.

The present invention is not limited to the specifically disclosed embodiments, and variations and modifications may be made without departing from the scope of the present invention.

The present application is based on Japanese priority application No. 2001-248219 filed on Aug. 17, 2001, the entire contents of which are hereby incorporated by reference.

What is claimed is:

1. A continuous-medium-box feeding device feeding a continuous-medium box to a printing device printing on a continuous medium fed from the continuous-medium box containing the continuous medium, the continuous-medium-box feeding device comprising:

a set table capable of sliding between a first position and a second position adjacent to said first position, the first position enabling the continuous medium to be fed from the continuous-medium box to said printing device, and the second position enabling the continuous-medium box to be removed manually; and a stand-by table capable of sliding between said first position and a third position adjacent to said second position, the second position and the third position enabling a continuous-medium box containing a continuous medium to be printed on next to be placed manually, wherein said stand-by table can feed the continuous-medium box on said set table positioned at said first position.

2. The continuous-medium-box feeding device as claimed in claim 1, further comprising a continuous-medium-box holder holding the continuous-medium box on said set table, the continuous-medium box being shifted from said stand-by table onto said set table by sliding said stand-by table from said third position to said first position.

3. The continuous-medium-box feeding device as claimed in claim 1, further comprising a box remover pushing out the continuous-medium box off said set table positioned at said second position.

4. The continuous-medium-box feeding device as claimed in claim 1, further comprising:

a set-table sliding unit sliding said set table between said first position and said second position;

a stand-by-table sliding unit sliding said stand-by table between said third position and said first position; and a control circuit controlling operations of said set-table sliding unit and said stand-by-table sliding unit to firstly shift said set table from said first position to said second position, subsequently shift said set table from said second position to said first position, and finally shift said stand-by table from said third position to said first position so that the continuous-medium box containing the continuous medium to be printed on next is fed onto said set table positioned at said first position in place of the continuous-medium box having fed the continuous medium to said printing device.

5. The continuous-medium-box feeding device as claimed in claim 1, wherein said set table comprises a positioning mechanism positioning the continuous-medium box fed on said set table by said stand-by table.

6. The continuous-medium-box feeding device as claimed in claim 1, further comprising:

a set-table locking unit locking said set table at said first position during a printing operation, and unlocking said set table after the printing operation; and a stand-by-table locking unit locking said stand-by table at one of said second position and said third position adjacent to said set table when the continuous-medium box is placed on said set table.

7. A continuous-medium-box feeding device feeding a continuous-medium box to a printing device printing on a continuous medium fed from the continuous-medium box containing the continuous medium, the continuous-medium-box feeding device comprising:

a first table capable of sliding between a continuous-medium feeding position and a continuous-medium-box loading/unloading position, the continuous-medium feeding position enabling the continuous medium to be fed from the continuous-medium box to said printing device, and the continuous-medium-box loading/unloading position enabling the continuous-medium box to be unloaded from the table and enabling a continuous-medium box containing a continuous medium to be printed on next to be loaded on the table; and a second table capable of being loaded with the continuous-medium box containing the continuous medium, the second table sliding together with said first table so that said second table is positioned at said continuous-medium-box loading/unloading position when said first table is positioned at said continuous-medium feeding position, and that said second table is positioned at said continuous-medium feeding position when said first table is positioned at said continuous-medium-box loading/unloading position.

8. A continuous-medium printing device comprising:

a printing unit printing on a continuous medium fed from a continuous-medium box containing the continuous medium; and a continuous-medium-box feeding device feeding the continuous-medium box to said printing unit, the continuous-medium-box feeding device including:

a set table capable of sliding between a first position and a second position adjacent to said first position, the first position enabling the continuous medium to be fed from the continuous-medium box to said printing unit, and the second position enabling the continuous-medium box to be removed manually; and a stand-by table capable of sliding between said first position and a third position adjacent to said second position, the second position and the third position enabling a continuous-medium box containing a continuous medium to be printed on next to be placed manually, wherein said stand-by table can feed the continuous-medium box on said set table positioned at said first position.

9. A continuous-medium printing device comprising:

a printing unit printing on a continuous medium fed from a continuous-medium box containing the continuous medium; and a continuous-medium-box feeding device feeding the continuous-medium box to said printing unit, the continuous-medium-box feeding device including:

a first table capable of sliding between a continuous-medium feeding position and a continuous-medium-box loading/unloading position, the continuous-medium feeding position enabling the continuous medium to be fed from the continuous-medium box to said printing unit, and the continuous-medium-box loading/unloading position enabling the continuous-medium box to be unloaded from the table and enabling a continuous-medium box containing a continuous medium to be printed on next to be loaded on the table; and a second table capable of being loaded with the continuous-medium box containing the continuous medium, the second table sliding together with said first table so that said second table is positioned at said continuous-medium-box loading/unloading position when said first table is positioned at said continuous-medium feeding position, and that said second table is positioned at said continuous-medium feeding position when said first table is positioned at said continuous-medium-box loading/unloading position.

* * * * *